US006972679B2

(12) United States Patent
Liao

(10) Patent No.: US 6,972,679 B2
(45) Date of Patent: Dec. 6, 2005

(54) MULTI-PROCESSOR BURGLAR-PROOF APPARATUS

(76) Inventor: Yi-Chia Liao, No. 47, lane 93, Nioupu S. Rd., Hsinchu City (TW)

( * ) Notice: Subject to any disclaimer, the term of this patent is extended or adjusted under 35 U.S.C. 154(b) by 177 days.

(21) Appl. No.: 10/441,023

(22) Filed: May 20, 2003

(65) Prior Publication Data

US 2004/0233053 A1 Nov. 25, 2004

(51) Int. Cl.[7] ..... G08B 1/08

(52) U.S. Cl. ..... 340/539.14; 340/539.16; 340/539.17; 340/539.26

(58) Field of Search ..... 340/539.14, 539.16, 340/539.17, 539.18, 539.26

(56) References Cited

U.S. PATENT DOCUMENTS 3,925,763 A * 12/1975 Wadhwani et al. .... 340/825.36

* cited by examiner

*Primary Examiner*—Donnie L. Crosland
(74) *Attorney, Agent, or Firm*—Birch, Stewart, Kolasch & Birch, LLP

(57) ABSTRACT

A multi-processor burglar-proof apparatus includes a plurality of detection processors. At least one detection processor is located in each detection area and each detection processor is separately linked to a radio alarm and a radio help system by radio signals.

3 Claims, 10 Drawing Sheets

MULTI-PROCESSOR BURGLAR-PROOF APPARATUS

FIELD OF THE INVENTION

The present invention relates to a burglar-proof apparatus and particularly to a multi-processor burglar-proof apparatus that has a plurality of detection processors each is separately linked to a radio alarm and a radio help system by radio signals.

BACKGROUND OF THE INVENTION

Conventional burglar-proof systems such as the one shown in FIG. 1 generally have a plurality of sensors 2 installed on locations where intruders might invade and a receiving processor 1 located at a selected position. Such a burglar-proof system must have the receiving processor 1 installing on a fixed location. As installation of the receiving processor 1 must take into account of the possibility of being sabotaged, it must be located in a secret or concealed area. Because once the receiving processor 1 is damaged, all the sensors 2 are not effective and become useless. Since the receiving processor 1 has to be installed on a concealed location, user operation and maintenance becomes inconvenient.

Moreover, the size of the receiving processor 1 and sensors 2 is quite bulky. Except on some selected locations, they are not portable. In the event of natural disasters occur (such as earth quake, power failure, flood, avalanche, fire, or the like), they also do not provide help or contingent functions.

SUMMARY OF THE INVENTION

Therefore the object of the invention is to provide a multi-processor burglar-proof apparatus that has a plurality of detection processors. At least one detection processor is located in each detection area. Each detection processor is separately linked to a radio alarm and a radio help system by radio signals.

Another object of the invention is to provide a help function in the event of natural disasters occur. As each detection area has a detection processor, users can easily access the detection processor and use the functional input interface to ask for external assistance.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
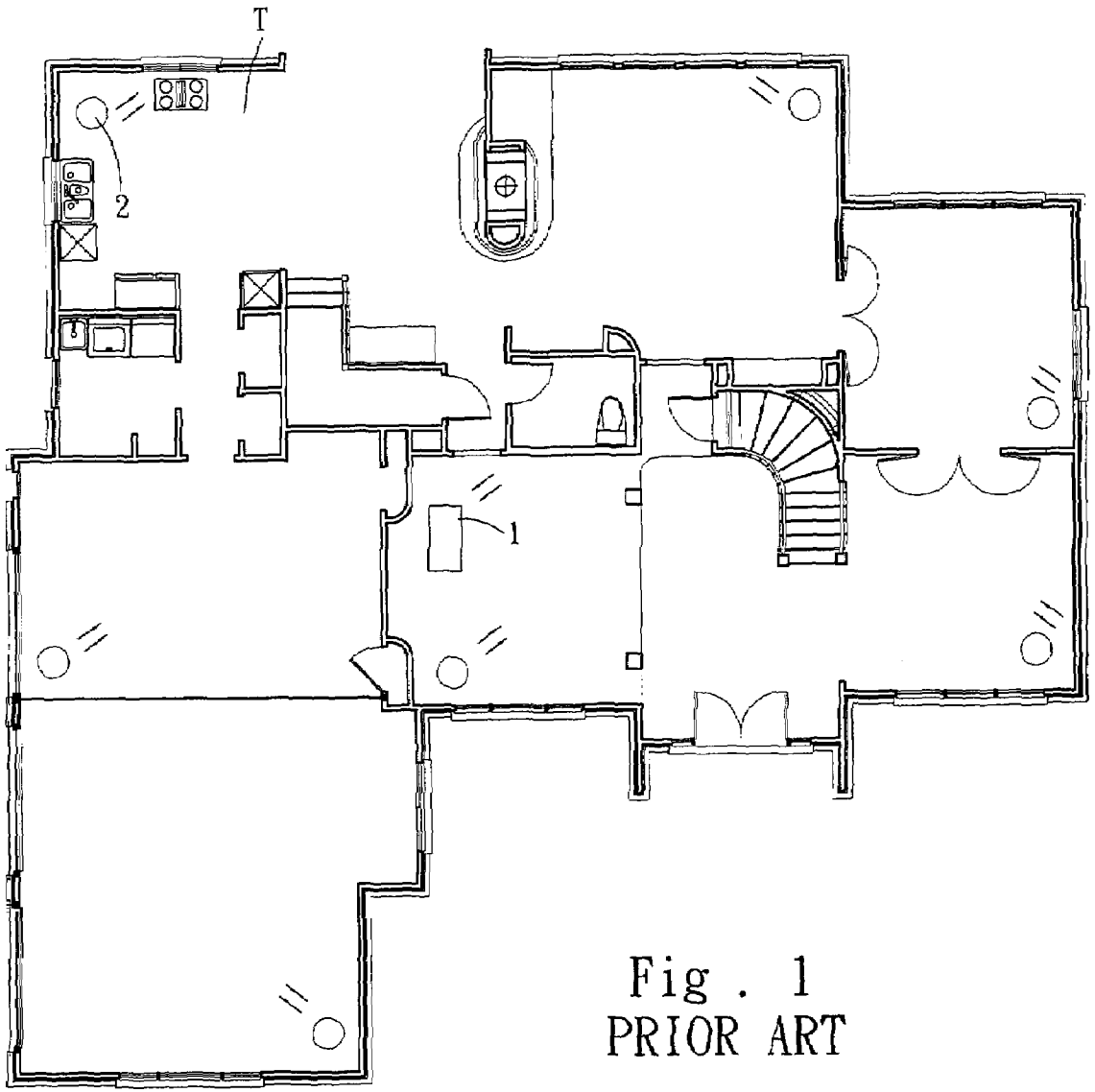
Fig. 1 PRIOR ART
FIG. 1 is a configuration layout of a conventional burglar-proof system.
Figure 2:
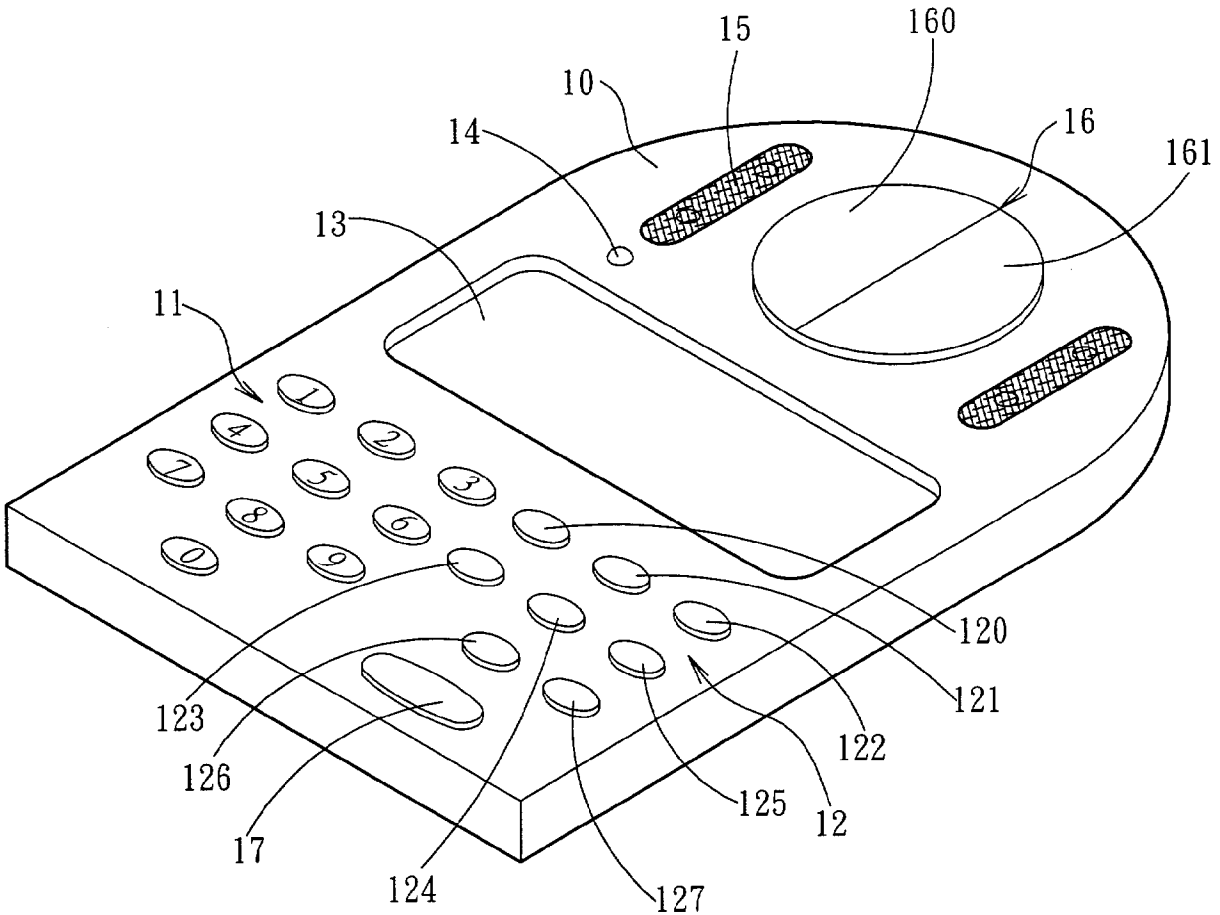
FIG. 2 is a perspective view of the present invention.

Please referring to FIG. 2, the multi-processor burglar-proof apparatus of the invention has at least one detection processor 10 installed on each detection area T. A plurality of the detection processors 10 are organized to form the burglar-proof apparatus of the invention. Each detection processor 10 has a case surface which contains:

a numerical input interface 11 for entering or setting passwords to release or reset the alarm of the detection processor 10, a functional input interface 12, a display interface 13, an alarm indication light 14, an indication light 15, a detection device 16 and a switch 17.

The detection device 16 includes:

an infrared light sensor 160 (may be a human body infrared light sensor) to automatically detect human body temperature or moving signals, a photosensitive sensor 161 to automatically detect brightness of light sources. The switch 17 is used to activate ON or OFF of the detection device 16, and the alarm indication light 14 illuminates when the switch 17 is activated.

The functional input interface 12 includes a lighting key 120, a luminescent key 121, a flashlight key 122, a time key 123, a power failure lighting key 124, an automatic lightening key 125, an automatic voice dialing key 126, and a SOS key 127.

In addition, referring to FIGS. 3 and 4A through 4K, the detection processor 10 includes a control circuit 20 which has a first control unit 21 and a second control unit 22. The first control unit 21 includes:

an infrared light sensor unit 201 for receiving signals from the infrared light sensor 160 and emitting detection signals to a microprocessor unit 204 which in turn issues signals to a radio emission unit 206, a memory unit 203 for storing signal status of other units such as password signals of an operation unit 202 or detected signals of the infrared light sensor unit 201, the microprocessor unit 204 which processes and controls the signals of other units and compares the passwords entered from the operation unit 202 with the password signals pre-stored in the memory unit 203 for decoding, the radio emission unit 206 which transmits the signals (such as alarm status and data) processed by the microprocessor unit 204 to a radio alarm 30 and a radio help system 40 by radio signals, and a power supply backup unit 210 which provides backup power supply for the control circuit 20 in the event of power failure. A charger unit 213 is included to charge electric power.

The second control unit includes: a photosensitive detection unit 200 for receiving signals detected by the photosensitive sensor 161 and transmitting the signals to the microprocessor unit 204 which in turn issues signals to a lighting unit 208, the operation unit 202 for entering input password signals into the microprocessor unit 204 to release the alarm condition of the detection processor 10, a display unit 207 to receive operation and status signals delivered by the microprocessor unit 204 and display the signals on the display interface 13, the lighting unit 208 receiving the signals from the microprocessor unit 204 to determine whether to turn light sources ON or OFF and adjust light brightness, an alarm unit 209 which receives signals from the microprocessor unit 204 and transmit signals to an alarm indication light 14, a speaker unit 211 which receives signals from the microprocessor unit 204 and generates alarm sound to alert operators, and a SOS help unit 212 which receives signals from the SOS key 127 and delivers signals to the microprocessor unit 204 so that the microprocessor unit 204 may generate Morse codes to the lighting unit 208, speaker unit 211 and radio emission unit 206.

Figure 3:
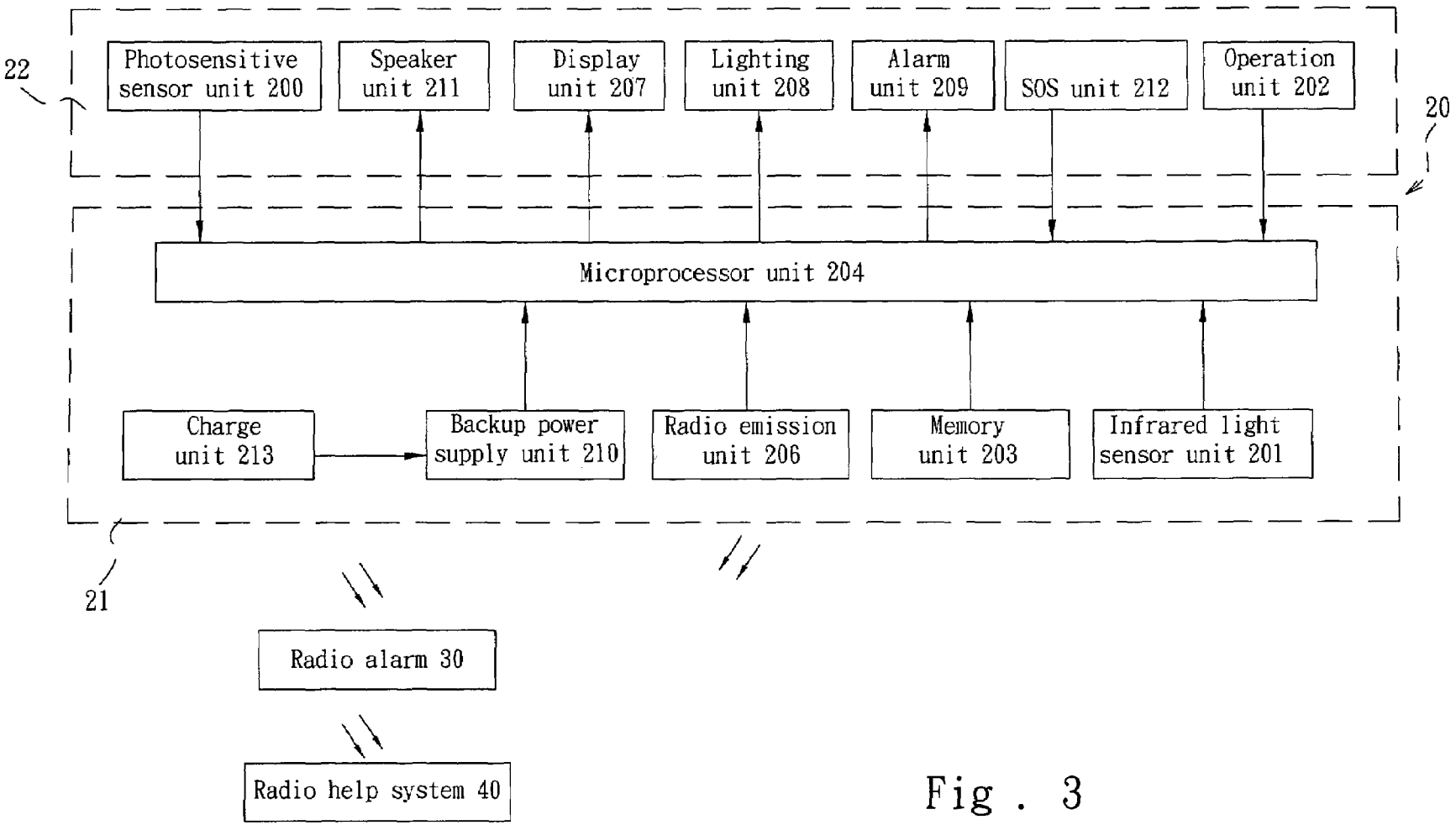
FIG. 3 is a block diagram of the control circuit of the present invention.
Figure 4A:
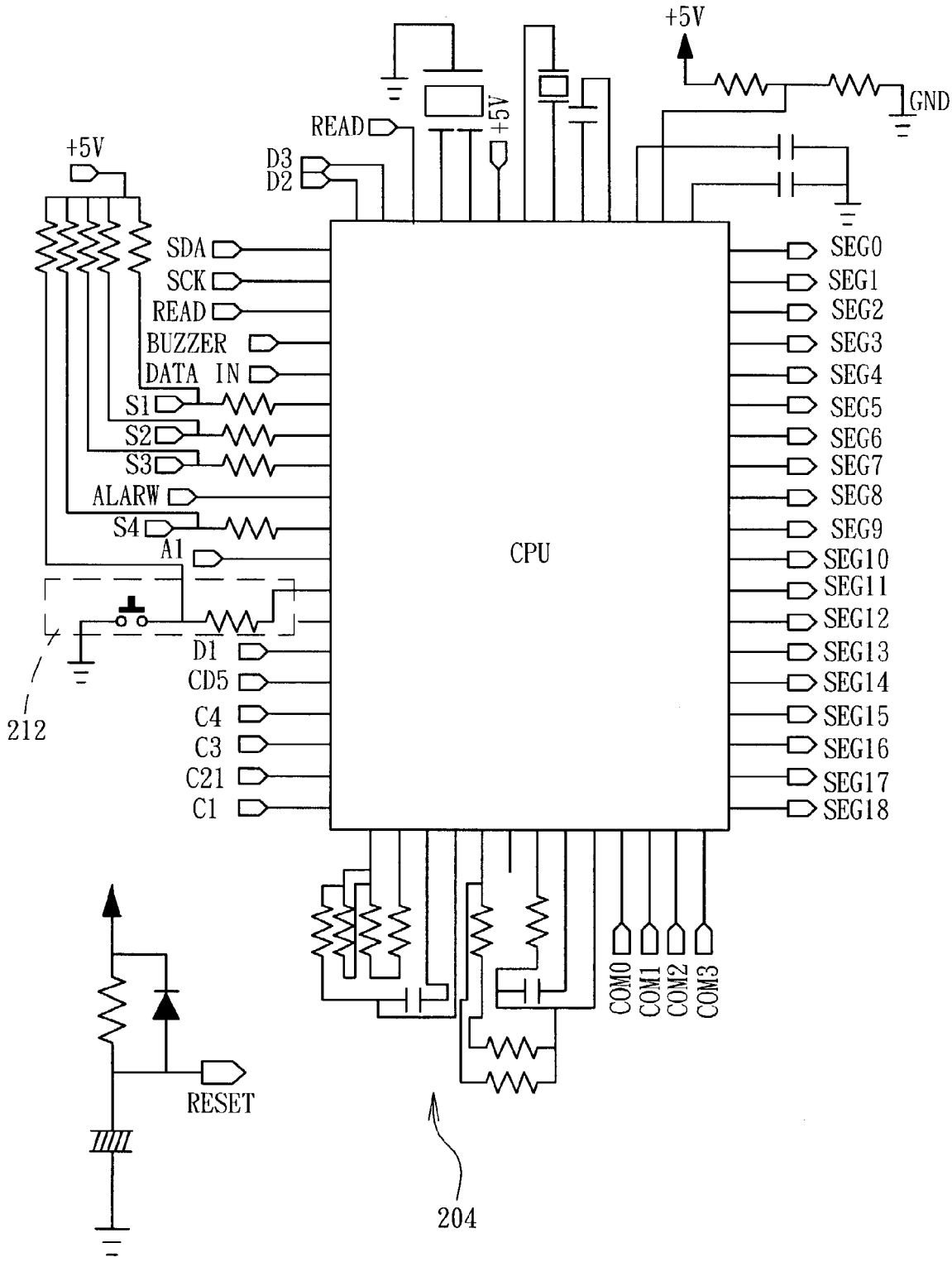
FIGS. 4A through 4K are circuit diagrams of the present invention.
Figure 4B:
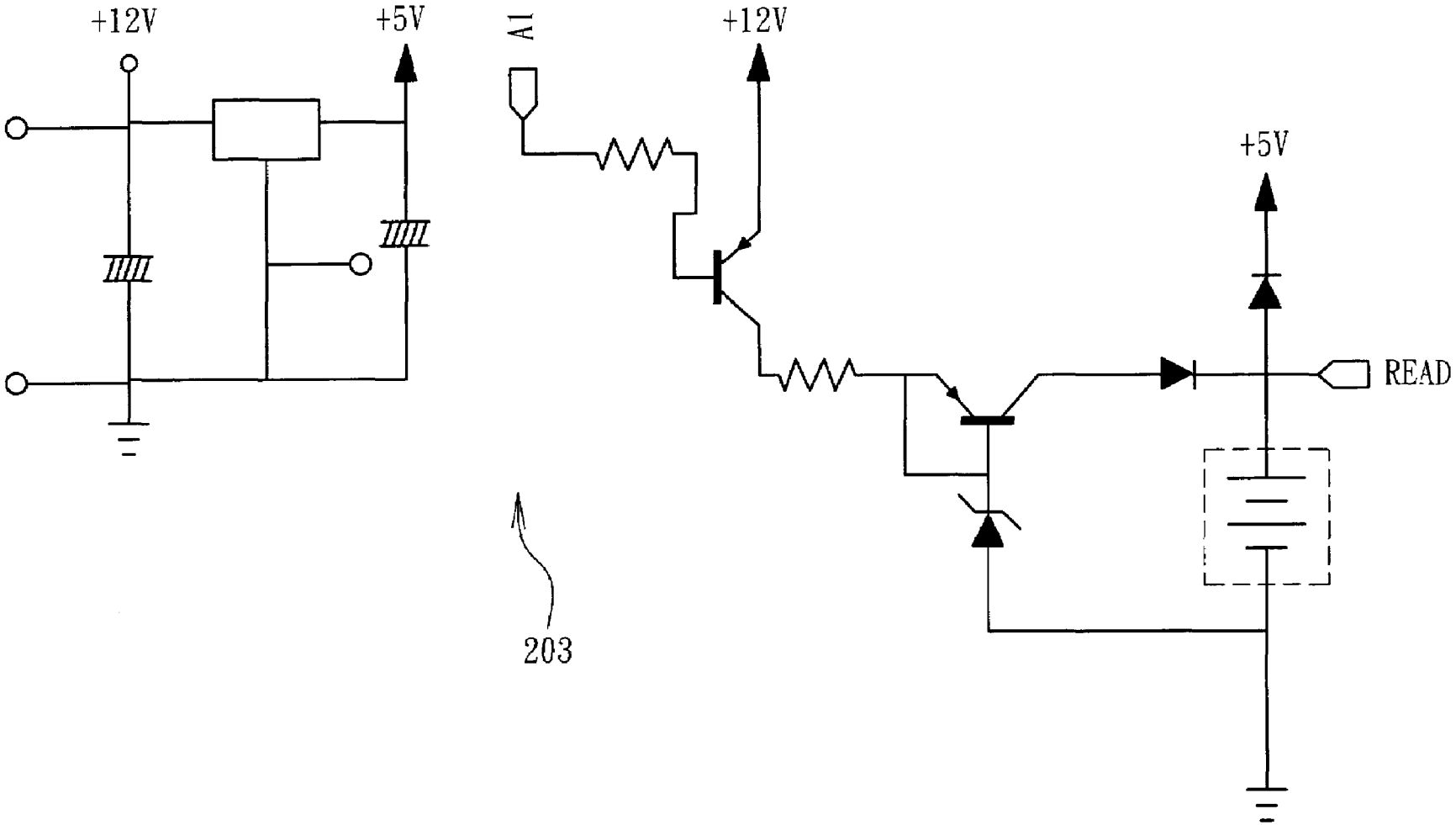
Figure 4D:
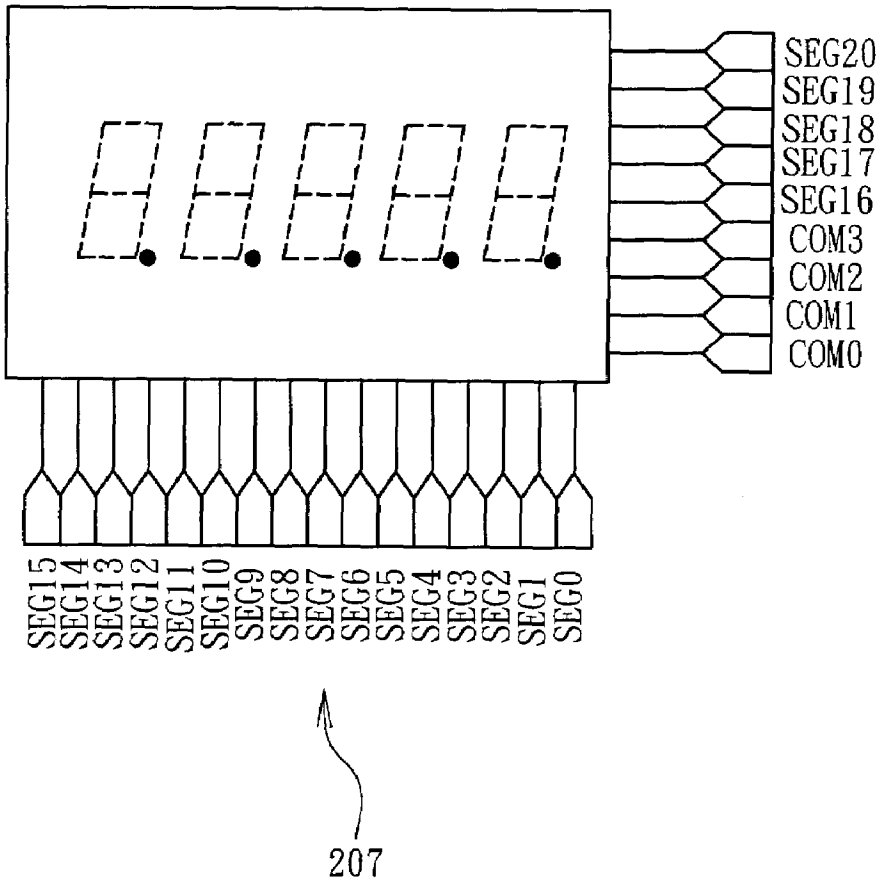
Figure 4C:
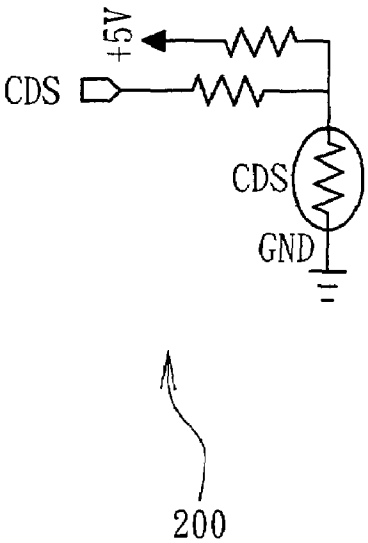
Figure 4E:
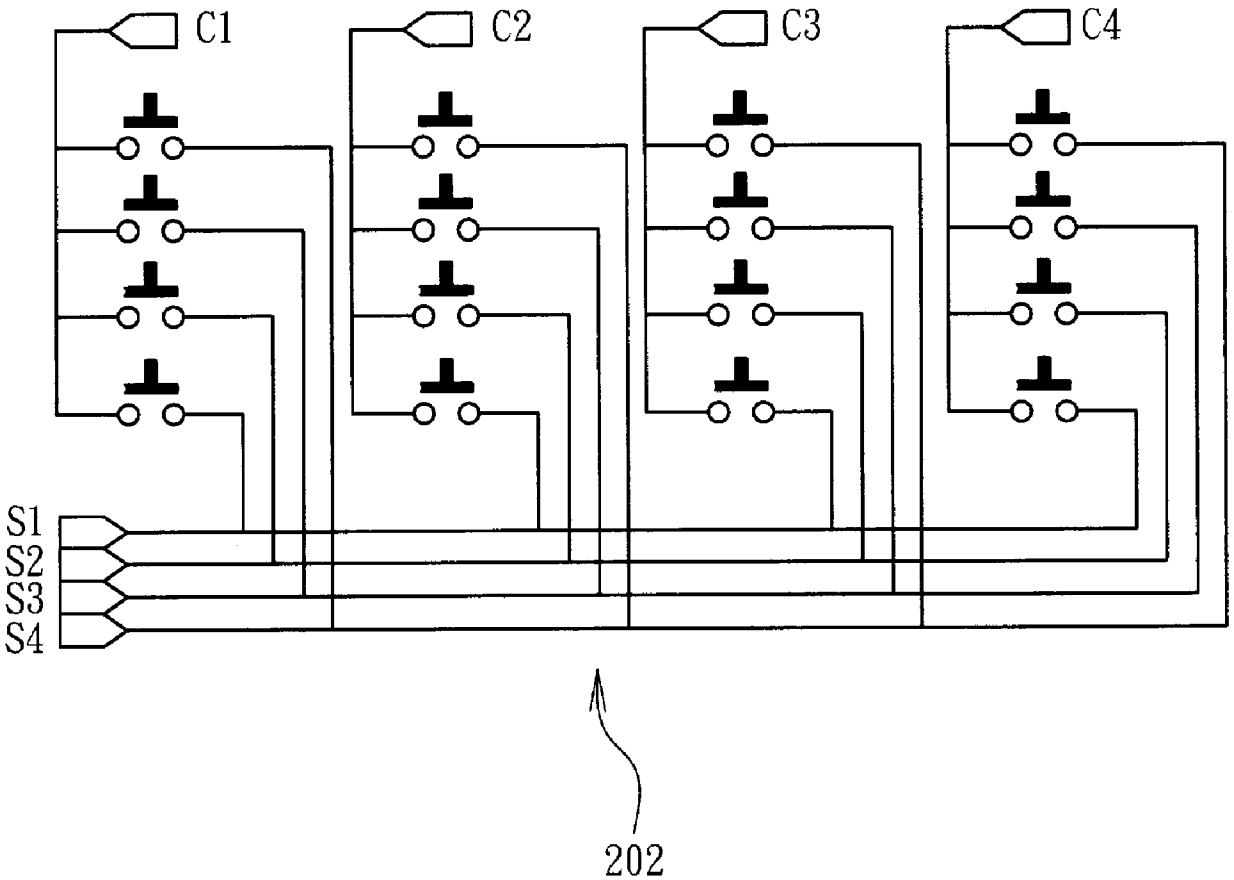
Figure 4H:
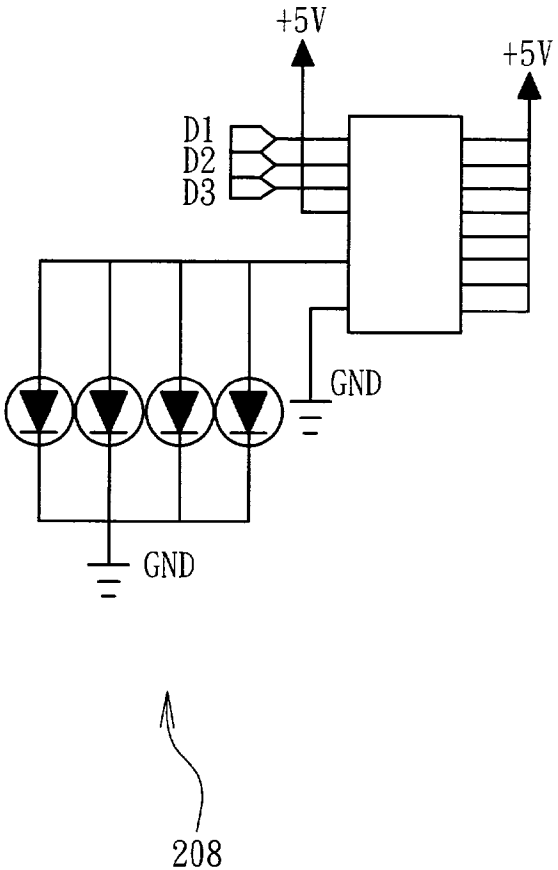
Figure 4G:
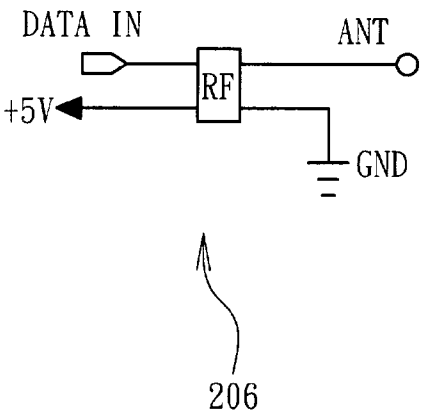
Figure 4F:
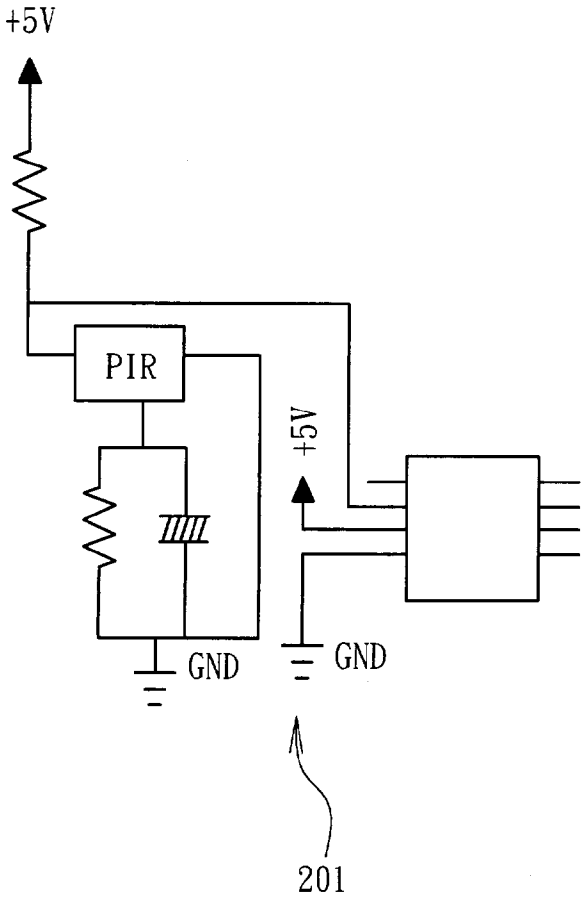
Figure 4K:
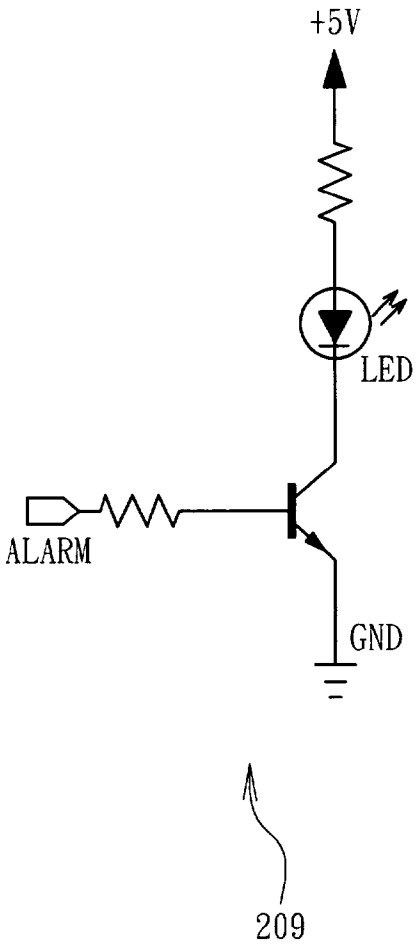
Figure 4J:
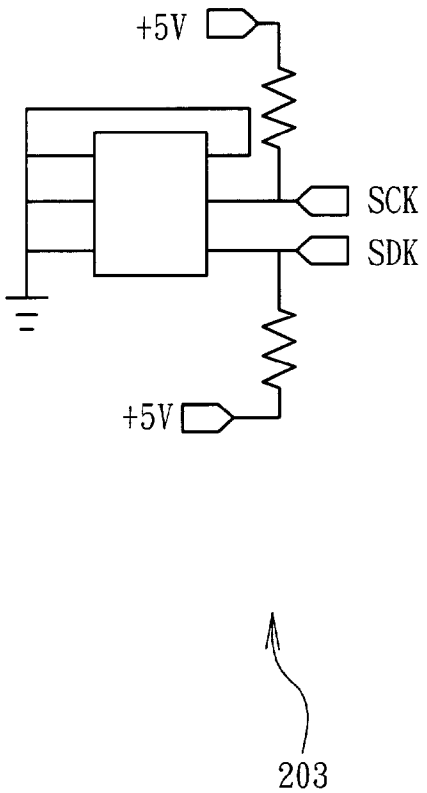
Figure 4I:
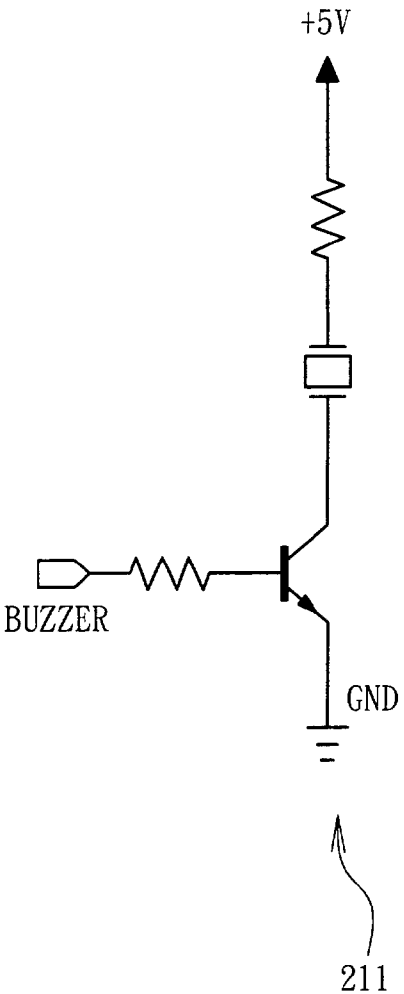
Figure 5:
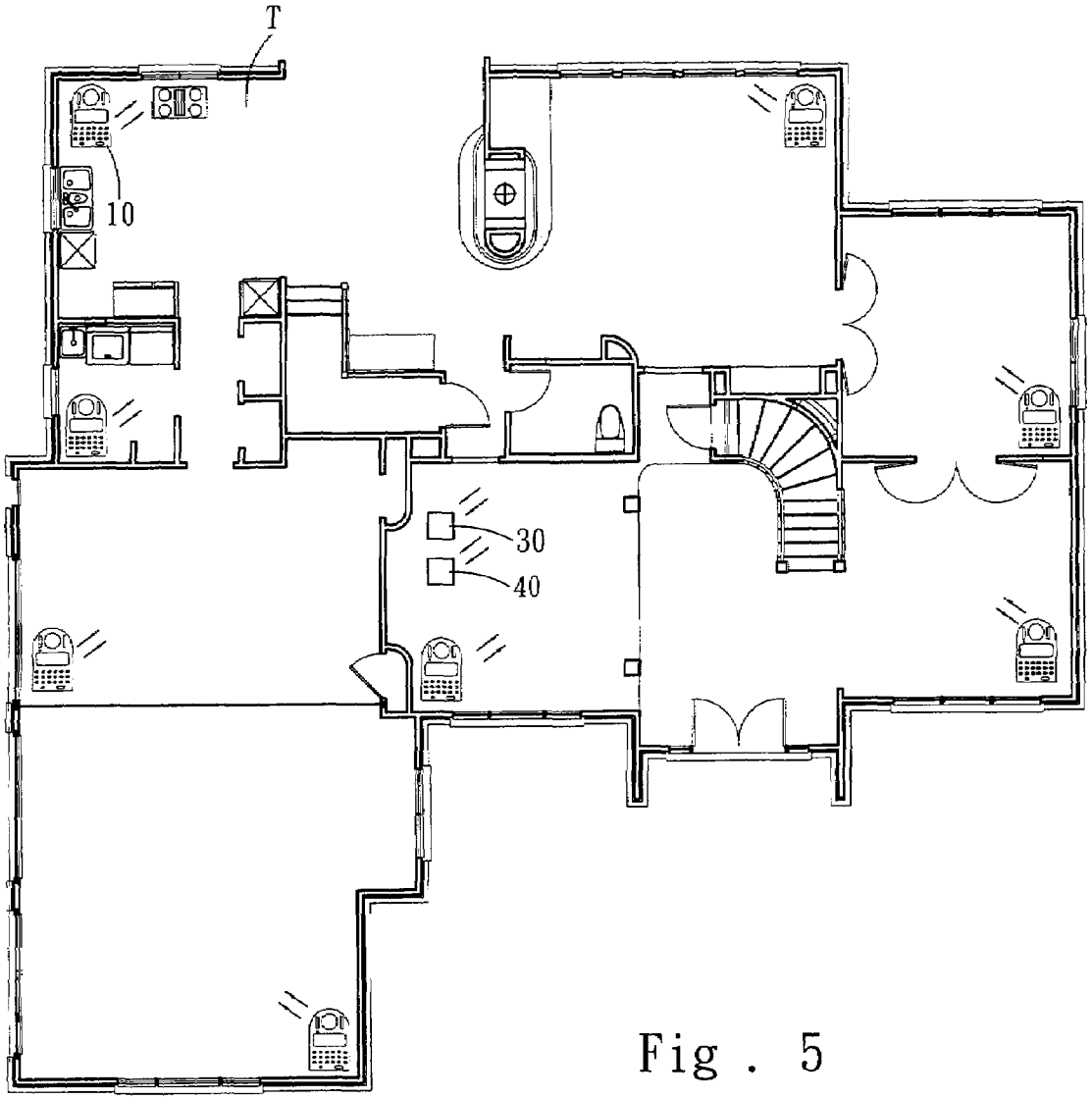
FIG. 5 is a configuration layout of the present invention.

Referring to FIGS. 2, 3 and 5, by means of the construction set forth above, the multi-processor burglar-proof apparatus of the invention can achieve the following effects:

1. Each detection area T has at least one detection processor 10, and a plurality of the detection processors 10 form the multi-processor burglar-proof apparatus. And each detection processor 10 is separately linked to the radio alarm 30 and the radio help system 40 through a radio transmission. Thus when intruders invade and are detected by the infrared light sensor 160, the microprocessor unit 204 of the control circuit 20 transmits signals to the radio alarm 30 and the radio help system 40 by radio signals to achieve burglar prevention object. It is to be noted that even if the intruder discovers and disables the detection processor 10 in one detection area T, the detection processors 10 in the rest detection areas T are still functionable and can continuously process detection. Moreover, when the detection processor 10 is disabled, the detection signals have already been sent to the radio alarm 30 and the radio help system 40. This is a significant difference from the conventional burglar-proof systems. As the conventional burglar-proof systems generally have a plurality of sensors 2 located in each detection area, and a single processor 1 receives the detected signals from the sensors 2 and activates the alarm and help system 3 and 4, once the processor 1 is disabled, all the sensors 2 deployed in the house are useless.
2. The detection processor 10 of the invention has a backup power supply unit 210. Power failure is not a concern. Moreover, users can easily reset and release the password of alarm status through the numerical input interface 11 of the detection processor 10. Thus the detection processor 10 may be installed wherever users want without the need of concealing. Once the detection processor 10 detects intruders, a preset audio alarm will be generated, and light will be projected to scare off the intruders and achieve burglar prevention effect.
3. Aside from generating alarm or help signals when detecting intruders, the SOS key 127 on the detection processor 10 may also be used to generate Morse code signals in the event of earth quake or fire to increase helping chance. Thus the invention has a greater added value and is less likely be idled.
4. The invention can also provide other functions such as illumination besides burglar prevention. The photosensitive sensor unit 200 in the control circuit 20 of the detection processor 10 can automatically detect the brightness of light sources and transmit suitable signals to the microprocessor unit 204 which issues signals to the lighting unit 208 to control ON or OFF of the indication light 15. Thus in the event of users return home at night or power failure occurs, the detection processor 10 can automatically generates light to indicate passages or escape routes. In the event of power failure, the flashlight key 122, power failure lighting key 124, and automatic lightening key 125 of the detection processor 10 can provide lighting function.

What is claimed is:

1. A multi-processor burglar-proof apparatus comprising a plurality of detection processors with at least one detection processor located in each detection area and each detection processor is separately linked to a radio alarm and a radio help system by radio signals, the detection processor having a control circuit which includes a first control unit and a second control unit, the second control unit being connected to the first control unit;

wherein the first control unit includes:

a memory unit for storing signal status;

a microprocessor unit for processing and controlling signals and comparing passwords input with passwords pre-stored in the memory unit to process decoding;

an infrared light sensor unit for emitting infrared light detection signals to the microprocessor unit;

a radio emission unit for emitting signals from the microprocessor unit;

a radio alarm for receiving signals from the radio emission unit;

a radio help system for receiving signals from the radio emission unit;

a backup power supply unit for providing backup electric power supply to the control circuit and to charge through a charge circuit, the backup power supply unit being connected to the microprocessor unit.

2. The multi-processor burglar-proof apparatus of claim 1, wherein the second control unit includes:

a lighting unit for receiving signals from the microprocessor unit to determine whether to turn light sources ON or OFF and adjust the brightness of the light sources;

a photosensitive sensor unit for transmitting light source detection signals to the microprocessor unit which issues signals to the lighting unit;

an operation unit for entering the passwords to the microprocessor unit to release alarm conditions of the detection processor;

a display unit for displaying operation and status signals issued from the microprocessor unit;

an alarm unit for receiving signals from the microprocessor unit and transmitting signals to an alarm indication light;

a speaker unit for receiving signals from the microprocessor unit and generating sound to alert operators; and a SOS unit for receiving signals from a SOS key and transmitting signals to the microprocessor unit which issues signals to the lighting unit, the speaker unit and the radio emission unit.

3. The multi-processor burglar-proof apparatus of claim 1, wherein the detection processor has a case which has a surface containing:

a numerical input interface for entering/resetting the passwords;

a functional input interface;

a display interface;

an alarm indication light;

an indication light;

a detection device; and a switch;

wherein the detection device includes an infrared light sensor for automatically detecting human body temperature or moving signals and a photosensitive sensor for automatically detecting brightness of light sources;

wherein the functional input interface includes a lighting key, a luminescent key, a flashlight key, a time key, a power failure lighting key, an automatic lightening key, an automatic voice dialing key, and a SOS key.

* * * * *